United States Patent [19]

Bosch et al.

[11] 4,119,445

[45] Oct. 10, 1978

[54] HIGH STRENGTH ALLOY OF FERRITIC STRUCTURE

[75] Inventors: Richard A. Bosch; John A. Straatmann, both of Poland, Ohio

[73] Assignee: Youngstown Sheet and Tube Company, Youngstown, Ohio

[21] Appl. No.: 375,116

[22] Filed: Jun. 29, 1973

Related U.S. Application Data

[60] Continuation of Ser. No. 141,947, May 10, 1971, abandoned, which is a division of Ser. No. 725,136, Apr. 29, 1968, Pat. No. 3,625,780.

[51] Int. Cl.[2] ..... C22C 38/14

[52] U.S. Cl. ..... 148/36; 75/123 M; 75/124

[58] Field of Search ..... 75/123 M, 124; 148/2, 148/12, 12.3, 36

[56] References Cited

U.S. PATENT DOCUMENTS

| | | | |
|---|---|---|---|
| 2,059,893 | 11/1936 | Naumann | 75/123 M |
| 2,140,238 | 12/1938 | Leitner | 75/123 M |
| 2,736,648 | 2/1956 | Eckel | 75/123 M |
| 3,183,078 | 5/1965 | Ohtake et al. | 75/49 |
| 3,333,987 | 8/1967 | Schrader et al. | 148/2 |
| 3,492,173 | 1/1970 | Goodenow | 148/12 |
| 3,522,110 | 7/1970 | Shimizu et al. | 148/12 |
| 3,560,270 | 2/1971 | Reinbold et al. | 148/12 |
| 3,607,456 | 9/1971 | Forand | 148/12 |
| 3,671,334 | 6/1972 | Bucher | 75/124 |
| 3,853,639 | 12/1974 | Hughes | 148/12 C |

OTHER PUBLICATIONS

Titanium in Iron and Steel, Comstock, 1955, John Wiley & Sons, N.Y., pp. 163–178, 182–184.

*Primary Examiner*—Arthur J. Steiner
*Attorney, Agent, or Firm*—John Stelmah

[57] ABSTRACT

Low alloy high strength titanium steel and a process for preparing said steel by solution heat treating and thereafter controlling the cooling rate to the precipitation hardening temperature range required to produce a steel characterized by a yield strength in the range of 60,000 to 120,000 psi and/or by a bendability characteristic demonstrable by a capability of being bent through an arc without cracking to an inside diameter equal to the thickness of the product.

4 Claims, No Drawings

HIGH STRENGTH ALLOY OF FERRITIC STRUCTURE

CROSS-REFERENCE TO RELATED APPLICATION

This is a continuation of copending application Ser. No. 141,947, filed May 10,1971, now abandoned, which in turn is a division of and similarly entitled to the benefit of the filing date of application Ser. 725,136, filed Apr. 29, 1968, now U.S. Pat. No. 3,625,780.

OBJECTS AND SUMMARY OF THE INVENTION

This invention relates to the production of a new series of precipitation hardened ferritic steels which utilize titanium as the major strengthening agent. These steels, when produced in accordance with the specified processing cycle, develop yield strengths in the range of 60,000–120,000 psi and exhibit desirable cold formability and weldability characteristics. The described process is particularly adaptable to the production of flat rolled products and can be utilized in the production of other steel products.

The present invention provides for an alloy of ferritic structure having a yield strength in the range of 60,000 to 120,000 psi consisting essentially of, by weight, 0.03 to 0.20% carbon, 0.04 to 0.35% titanium, and the principal portion of the remainder being iron with ordinary impurities. It further provides an alloy as described above wherein the remainder includes manganese in the range of 0.3 to 1.5% of the total alloy weight. The remainder also includes the residue of a killing agent (or deoxidizing agent) selected from the group consisting of aluminum, silicon, additional titanium and zirconium. Preferably, the killing agent is aluminum comprising 0.02 to 0.07% of the total composition from which said alloy is prepared. In its preferred form, the alloy consists essentially of 0.04 to 0.10% carbon, 0.20 to 0.32% titanium, and the balance iron with residual impurities in ordinary amounts and exhibits a yield strength of 60,000 to 110,000 psi.

The invention further provides for a process for producing an alloy of ferritic structure having a yield strength in the range of 60,000 to 120,000 psi comprising the steps of (A) solution heat treating an alloy composition consisting essentially of 0.03 to 0.20% carbon, 0.04 to 0.35% titanium, and the principal portion of the remainder being iron with residual impurities in ordinary amount; (B) quenching said alloy composition to a temperature in the range of 1000° to 1225° F.; and (C) precipitation treating said alloy composition. It is further provided that the alloy composition is cooled to room temperature after the step of precipitation treating.

In its preferred form the process provides for solution heat treating which comprises heating the alloy composition to a uniform temperature above about 2000° F. for at least 5 minutes. The process further provides for quenching which comprises cooling the alloy to a temperature of not less than 1500° F. at a rate greater than 1° F. per second and thereafter maintaining a cooling rate in the range of 7.5° to 75° F. per second, preferably at a rate greater than 15° F. per second until reaching a temperature in the range of 1000° to 1225° F. by directing a coolant such as water upon one or more surfaces of the alloy. Preferably, the precipitatior treating comprises cooling at a rate generally less than 100° F. per minute until reaching a temperature of about 900° F.

The present invention additionally provides for steel produced from the composition described above according to the process described above and being characterized by yield strengths in the range of 60,000 to 120,000 psi.

DESCRIPTION OF PREFERRED EMBODIMENT

The influence of chemcial composition and processing on the mechanical properties of precipitation hardened steels produced by the process of the invention will now be described in detail.

The following example discloses the ranges of the principal elements of a composition from which a low alloy steel within the scope of the present invention is prepared:

| Element | Percent by Weight |
|---|---|
| Carbon (C) | 0.03–0.20 |
| Manganese (Mn) | up to 1.5 |
| Sulfur (S) | 0.03 maximum |
| Phosphorus (P) | 0.015 maximum |
| Silicon (Si) | up to 0.30 maximum |
| Nitrogen (N) | up to 0.01 |
| Titanium (Ti) | 0.04–0.35 |
| Aluminum (Al) (or other killing agent) | 0.02–0.07 |

Iron constitutes the base of the alloy and comprises the balance of the composition with the exception of insignificant amount of impurities incident to usual steelmaking practice such as iron oxides, other metallic oxides, and the like.

An important element of the steels produced in accordance with the invention is titanium (Ti). Ti is present in the range of 0.04–0.35% depending on the strength level desired. A linear relationship between yield strength and Ti content has been observed up to 0.3% Ti. It is believed that the principal strengthening influence upon precipitation hardened steels produced by the process of the invention is a fine dispersion of titanium carbonitride (TiCN) formed during transformation to ferrite. The ferrite matrix produced is almost completely void of pearlite.

* TiCN as used herein is an abbreviation, not a chemical symbol, for titanium carbonitride in a solid-solution series between TiC and TiN.

The carbon and nitrogen concentration influence the strength of these steels as shown in Table I below for flat rolled products as two titanium concentrations produced within the processing conditions of the invention. Specifically, the steels tabulated in Table I were forged and hot rolled from 50 lb. air induction melted laboratory ingots. Samples were prepared from forged $\frac{7}{8}$ inch plates. The samples were processed in a laboratory apparatus which simulates an actual hot strip mill installation and the conditions connected therewith. The processing steps comprised heating the samples at a solution temperature of 2100° F. for 8 minutes, air cooling during hot deformation at a rate of 3° F. per second, finishing hot deformation at a temperature greater than 1500° F., quenching by fluid spray such as water, to a temperature in the range of 1000°–1300° F., followed by a cooling sequence which provides cooling at a rate generally less than 100° F. per minute until reaching a temperature of about 900° F. and thereafter air cooled to room temperature. Standard procedures were used to test the tensile and impact specimens obtained from the samples processed by the foregoing procedure.

As shown in Table I, at the 0.17/0.19 titanium concentration, an increase in carbon content from 0.06–0.16% at the 0.002 nitrogen level resulted in a decrease of 30,000 psi in the yield strength. Raising the nitrogen level from 0.0017 to 0.01% resulted in a similar loss in strength. The same trends are shown, but to a lesser magnitude on the steels containing 0.04% titanium. For optimum strength in these steels, the carbon concentration should be between 0.04 and 0.10%. Higher carbon concentrations could be utilized but at a sacrifice in strength. The lowest nitrogen level is preferred and should be below 0.01% to produce flat rolled products with 90,000 psi minimum yield strength.

TABLE I

| Titanium Content (wt %) | Carbon Content (wt %) | Ti/C | Nitrrogen Content (wt %) | Yield Strength (psi) | Tensile Strength (psi) |
|---|---|---|---|---|---|
| .19 | .06 | 3.1/1 | .0017 | 105,600 | 125,000 |
| .18 | .10 | 1.8/1 | .002 | 94,900 | 114,800 |
| .18 | .16 | 1.1/1 | .002 | 75,200 | 103,500 |
| .17 | .07 | 2.4/1 | .01 | 74,700 | 94,000 |
| .04 | .07 | .57/1 | .0016 | 60,000 | 75,200 |
| .04 | .12 | .33/1 | .002 | 55,850 | 73,500 |
| .04 | .07 | .57/1 | .008 | 47,450 | 63,550 |

The steels of the present invention exhibit desirable welding characteristics because the normal elements which cause difficulty in welding are not present in significant amounts; that is, the manganese and carbon concentrations are kept low enough to achieve good weldability. Higher manganese levels can be used to produce higher strengths with some sacrifice in weldability.

Nickel and copper may be added to these steels without detriment to the mechanical properties and will improve the atmospheric corrosion resistance as is known to those skilled in the art. However, nickel and copper are not essential to the primary strengthening mechanisms in the titanium steels.

The addition of other strengthening agents such as vanadium and molybdenum will result in strength increases above those associated with the particular titanium base. The addition of vanadium would be most beneficial where a high nitrogen residual level occurs, since the presence of vanadium results in the formation of vanadium nitride which increases the strength and also decreases the amount of nitrogen that is available for association with the titanium.

A unique method has been discovered for processing the steels described herein to impart strength and other physical properties to such steels on present-day strip mill facilities which steels heretofore could only be developed by the use of expensive techniques and expensive alloy ingredients. The first step comprises subjecting the metal to a high solution temperature. A high solubility of Ti in the austenite is necessary so that reprecipitation of the Ti as TiCN can be controlled to insure a fine dispersion throughout the ferrite matrix. In the case of the Ti steels, the solution temperature must be above 2000° F. which corresponds to the normal temperature attained in the conventional hot strip slab reheat furnaces. The steel is subjected to the solution temperature until heated uniformly to a temperature above 2000° F. and then held at that temperature for at least 5 minutes to insure that the TiCN goes fully into solution.

In commercial steelmaking practice, the steel ordinarily would be subjected to hot deformation after solution heat treatment. However, no deformation is required to develop the desirable properties in the steels of the present invention.

Whether or not deformation is performed, a cooling rate in excess of 1° F. per second is maintained while cooling from the solution heat treating temperature. This cooling rate assures that transformation of austenite to ferrite will not commence above 1500° F. As discussed below, a rapid cooling rate through the austenite transformation range is desired to achieve the high yield strengths in the steels of the present invention. The higher cooling rate should be established well before the temperature at which transformation commences is reached. For this reason, any hot deformation which is performed should be completed (finished) at a temperature above 1500° F. The precise temperature at which austenite transformation begins in a particular alloy composition being cooled at a particular rate can be ascertained by dilatometric methods as described in the Metals Handbook, 1948 Edition, pages 168–174 or by any other convenient method.

The effect of maintaining a cooling rate greater than 1° F. per second during cooling from the solution heat treating temperature is illustrated in Table II-A below for a 0.18% Ti steel. The data in Table II was developed by processing steels in the same manner as that described for Table I above. An increase in the cooling rate from 1° F. to 3° F. per second resulted in yield strength increase of approximately 10,000 psi.

TABLE II

| Processing Variable Investigated | Parameters Major Alloying Elements | Strength | Yield Strength (psi) | Tensile (psi) |
|---|---|---|---|---|
| A | | | | |
| Cooling rate between solution temp. and finish deformation temp. | 3 F °/Sec. | .18 wt% Ti | 97,600 | 115,950 |
| | 1 F °/Sec. | " | 87,300 | 106,200 |
| B | | | | |
| Temperature after cooling at 45 F °/Sec. | 1000° F | .14 wt% Ti | 76,550 | 90,550 |
| " | 1100° F | " | 81,950 | 96,700 |
| " | 1200° F | " | 81,800 | 99,300 |
| " | 1225° F | " | 75,150 | 93,100 |
| " | 1250° F | " | 70,400 | 84,100 |

The effect of cooling rate from the finish deformation temperature to the precipitation treating temperature on the yield strength is shown in Table III, the data for which having been developed in the same manner as described for Table I above:

TABLE III

| Major Alloying Elements | Cooling Rate F °/Sec. | Yield Strength (psi) | Tensile Strength (psi) |
|---|---|---|---|
| .23 Ti | 75 | 110,600 | 127,800 |
| .23 Ti | 45 | 118,500 | 135,500 |
| .23 Ti | 15 | 103,300 | 123,100 |
| .23 Ti | 7-½ | 89,000 | 109,100 |
| .23 Ti | 3 | 68,550 | 95,950 |
| .04 Ti | 75 | 59,250 | 75,000 |
| .04 Ti | 45 | 60,000 | 75,200 |
| .04 Ti | 15 | 54,650 | 70,300 |
| .04 Ti | 7-½ | 50,350 | 67,100 |
| .04 Ti | 3 | 46,600 | 63,000 |

A cooling rate of 45° F. per second yielded the highest strength at both high and low titanium levels. A decrease in cooling rate from 45° F. per second resulted in a marked decrease in yield strength.

The development of maximum strength by employing a cooling rate ranging between 7.5° to 75° F. is believed to be dependent on a rapid cooling through the austenite range into the austenite + ferrite range so that precipitation of TiCN coincides with the transformation to ferrite (rather than prior precipitation of TiCN in austenite). It has been found that the temperature for this advantageous precipitation of TiCN is in the range of 1000°-1225° F. See Table II-B. This range establishes the desirable temperature range in which the steel is coiled. Our studies indicate that if a uniform coiling temperature is obtained, no variation in strength should occur from head to tail or from center to edge, widthwise, in a coil processed in a conventional strip mill.

These titanium steels exhibit elongations greater than 20 percent in 2 inches and a reduction in area greater than 50 percent in both strip and plate. A beneficial cold formability characteristic is demonstrated by the ability to bend at all strength levels through 180° without cracking to an inside diameter equal to the material thickness. The impact strength in the 60,000/70,000 psi yield strength range is greater than 15 ft-lbs. at a test temperature of −50° F.

What is claimed is:

1. A killed ferrous low alloy flat rolled product of a composition consisting essentially of, in percentage by weight, 0.03–0.20 carbon, 0.04–0.35 titanium as a primary strengthening agent, 0.02–0.07 killing agent selected from the group consisting of aluminum, silicon, additional titanium, and zirconium, up to 1.5 manganese, 0.03 maximum sulfur, 0.015 maximum phosphorus, up to 0.30 silicon, up to 0.01 nitrogen, the remainder being essentially iron, and characterized by:

a fine dispersion of titanium carbonitride in a ferrite matrix, and a cold formability demonstrable by a capability of being bent through an arc, without cracking, to an inside diameter equal to the thickness of the product.

2. A product as described in claim 1, which is further characterized by:

a yield strength in the range of 60,000 to 120,000 psi.

3. A product, as described in claim 1, which exhibits:

an elongation greater than 20 percent in 2 inches and a reduction in area greater than 50 percent.

4. A product, as described in claim 1, which is further characterized by a yield strength of at least 46,600 psi.

* * * * *